US005369968A

United States Patent [19]

Bertoldo

[11] Patent Number: 5,369,968

[45] Date of Patent: Dec. 6, 1994

[54] APPARATUS FOR CONTINUOUS STEAMING AND DIMENSIONAL STABILIZATION OF CONTINUOUS FABRIC WEBS

[75] Inventor: Franco Bertoldo, Brogliano, Italy

[73] Assignee: Sperotto Rimar S.p.A., Thiene, Italy

[21] Appl. No.: 45,949

[22] Filed: Apr. 15, 1993

[51] Int. Cl.[5] ..... D06B 3/10

[52] U.S. Cl. ..... 68/5 E

[58] Field of Search ..... 68/5 D, 5 E

[56] References Cited

U.S. PATENT DOCUMENTS

| | | | |
|---|---|---|---|
| 2,494,731 | 1/1950 | Vincent et al. | 68/5 D |
| 2,833,136 | 5/1958 | Prince et al. | 68/5 D |
| 3,041,863 | 7/1962 | Goto | 68/5 E |
| 3,686,902 | 8/1972 | Fleissner et al. | 68/5 D |
| 4,070,877 | 1/1978 | Fleissner | 68/5 D |

FOREIGN PATENT DOCUMENTS

| | | | |
|---|---|---|---|
| 0297029 | 12/1988 | European Pat. Off. | D06B 19/00 |
| 1576836 | 8/1969 | France | D06B 19/00 |
| 2147238 | 3/1973 | France | D06C 7/02 |
| 2845586 | 5/1979 | Germany | 68/5 E |

*Primary Examiner*—Philip R. Coe

*Attorney, Agent, or Firm*—Cushman Darby & Cushman

[57] ABSTRACT

An apparatus for continuous steaming and dimensional stabilization of continuous fabric webs includes a steaming tunnel (11) through which a conveyor belt (12) runs, which supports and conveys a continuous fabric to be treated (13), the steaming tunnel (11) being provided with an inlet opening (14), an outlet opening (15) and a steam delivering device (16), in which apparatus the inlet opening (14) and the outlet opening (15) are both arranged under the bottom tunnel portion and inside the tunnel, opposite to at least one of the openings a temperature sensor (23) is provided which modulates the emission of steam from the steam delivering device (16). Furthermore, a method is accomplished for the steaming and dimensional stabilization of continuous fabric webs, method which is constituted by the treatment of fabric webs in an air-free atmosphere of saturated steam.

8 Claims, 1 Drawing Sheet

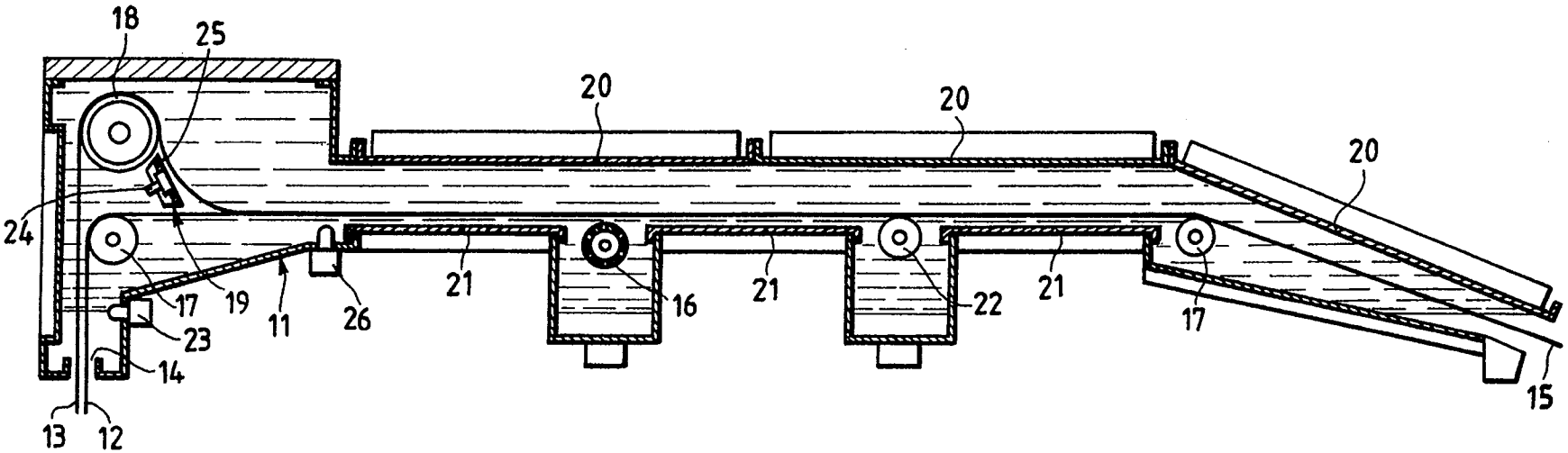
15
20
17
21
22
20
21
16
20
21
26
11
19
25
17
23
14
18
12
13
24

APPARATUS FOR CONTINUOUS STEAMING AND DIMENSIONAL STABILIZATION OF CONTINUOUS FABRIC WEBS

BACKGROUND OF THE INVENTION

The present invention relates to an apparatus for continuous steaming and dimensional stabilization of fabrics in the form of continuous webs.

At present, apparatuses are known and used for continuously performing the steaming, the relaxation, the shrinkage and the dimensional stabilization of fabrics in general. Under the generic term "fabrics", both fabrics of weft-warp type and knitted fabrics, as well as even non-woven fabric made from any materials of natural, man-made and synthetic origin, are to be understood.

The apparatuses known from the prior art have the purpose of determining a stabilization of the fabrics without applying any cross and/or longitudinal (i.e., in the machine direction) stresses to the material under treatment.

These apparatuses essentially are constituted by a conveyor belt and a tunnel inside which the fabric is caused to run through. The conveyor belt is arranged as a closed ring and has a partially open surface structure, such as constituted by a net, so as to be permeable after receiving the fabric to be treated.

The tunnel is assimilable to a steaming tank through which the fabric supporting conveyor belt runs. Under said conveyor belt, a steam delivering device, and over it a roof, or, anyway, a heated condensation preventing cover connected with a sucking hood with a vent fan are respectively provided. The vent fan also intakes the steam which leaves the tunnel through the inlet and outlet openings of the latter, through which the conveyor belt and the fabric web run, together with a certain air amount from the working premises.

Although they effectively treat the fabric and supply it with optimal, natural, stress-free relaxation and shrinkage effects, such a kind of apparatuses known from the prior art unfortunately display the following drawbacks.

High steam consumption, because the tunnel must be constantly kept filled with steam and in the mean time there is a continuous escape of steam from said tunnel inlet and outlet openings. In fact, the steam excess is continuously sucked, together with a certain air amount from the working premises, by the suction hood which is installed over the tunnel and is provided with a vent fan.

Continuous steam and air venting to the surrounding atmosphere, with considerably high energy consumption and waste for the treatment and the heating of steam and air from the working premises.

Treatment of fabric inside the tunnel with a mixed atmosphere of air and steam, with the treatment temperature being consequently limited at 100° C. or slightly higher temperatures, and incomplete and optimal dimensional stabilization of the fabric.

SUMMARY OF THE INVENTION

The purpose of the present invention is of providing an apparatus capable of overcoming the above drawbacks, so as to yield a treated fabric which is dimensionally stable, with a minimal energy amount and limited costs.

This purpose according to the invention is achieved by providing an apparatus for continuous steaming and dimensional stabilization of continuous fabric webs comprising a steaming tunnel through which a conveyor belt runs, which supports and conveys a continuous fabric web to be treated, with the steaming tunnel being provided with an inlet opening and an outlet opening and a steam delivering device, characterized in that the inlet opening and the outlet opening are both arranged under the lower tunnel portion and that inside the tunnel, opposite to at least one of the openings, a temperature sensor is provided with modulates the emission of steam from the steam delivering device.

BRIEF DESCRIPTION OF THE DRAWINGS

Characteristics and advantages of an apparatus according to the present invention will be better understood from the following exemplifying, non-limitative disclosure made by referring to the attached drawing, in which:

The sole FIGURE is a schematic sectional elevational view of an embodiment of apparatus provided in accordance with principles of the present invention.

DETAILED DESCRIPTION

Referring to the FIGURE, an apparatus is schematically illustrated for the continuous steaming and dimensional stabilization of continuous fabric webs according to the present invention.

The apparatus comprises a steaming tunnel (11) having the form of a tank, through which a conveyor belt (12) is caused to run, and which supports and conveys a continuous fabric web to be treated (13).

The steaming tunnel (11) is provided with an inlet opening (14) and an outlet opening (15), both connected with the external environment and arranged at a much lower level than the bottom floor of the tunnel. Inside the steaming tunnel (11) provided is a steam delivering device (16) to supply steam, which is constituted, e.g., by a perforated pipe which receives steam from a central steam generation unit, not shown in the FIGURE, and which extends transversely to the tunnel (11). In the depicted embodiment, such inlet and outlet openings, (14) and (15) respectively, are downwards oriented.

The conveyor belt (12) is endless, is arranged along the bottom tunnel portion on rollers (17) and forms a closed, endless ring around them (as partially shown in the FIGURE) and has a permeable surface structure, e.g., a net-like surface structure. Respective ones of the rollers (17) provide the conveyor belt (12) with a generally horizontal, upwardly facing carrying run for longitudinally successive increments of the continuous fabric web.

The fabric web (13) to be treated is driven into the interior of the steaming tunnel (11) by means of a motor-driven roller (18) which is installed in the upper portion of the tunnel positioned at the initial portion of the conveyor belt (12).

Downstream of the motor-driven roller (18), a fabric web deflection control device (19) is installed, which checks the fabric web (13) feed to the region of deposition of the fabric web on the conveyor belt (12). Along the upper, cover portion and along the bottom floor of the steaming tunnel (11), upper heated plates and lower heated plates (20) and (21), respectively, are installed in order to act on steam temperature. Furthermore, along the bottom portion of the tunnel (11) also a vibrator device (22) acting from the bottom on the conveyor belt (12) is installed, e.g., as consisting of a swinging roller.

Inside the steaming tunnel (11), just at the inlet opening (14) a first temperature sensor (23) is installed which is operatively connected with the steam delivering device (16) in order to command steam to be emitted, whenever necessary.

Inside the interior of the steaming tunnel (11), a second temperature sensor (26) is installed, which is operatively connected with the upper heated plates (20) and the lower heated plates (21), in order to control their regulation.

During the operation of the apparatus, the interior of the steaming tunnel (11) is filled with steam by means of the steam delivering device (16), so as to cause the inner tunnel air to escape from the tunnel through the inlet opening (14) and the outlet opening (15). When the tunnel (11) is filled with steam up to the lower level where the temperature sensor (23) is installed, the latter, by detecting, through the temperature, the presence of steam, modulates the emission of steam by the steam delivering device (16) or even stops the steam emission by means of a whatever modulating depicted, valve, not in that way preventing steam from escaping through the inlet opening (14) and the outlet opening (15).

Simultaneously, the upper and lower heated plates (20) and (21) respectively, are switched on at such a temperature as to cause steam to reach a predetermined temperature, e.g., comprised within the range of from 100° to 120° C. The function of the heated plates (20) and (21) is also of preventing condensate from forming inside the steaming tank (11). The regulation and switching-on of the plates is automatically carried out through an actuator device, not depicted in the FIGURE, connected with the second temperature sensor (26) and preset as a function of the treatment requirements.

The fabric web (13) is vertically driven from below upwards into the tunnel (11) through the inlet opening (14) by the motor-driven roller (18) and is deposited on the conveyor belt (12). The revolution speed of the motor-driven roller (18) is variable and is automatically regulated through the fabric web deflection control device (19) at its region of deposition on the conveyor belt (12). In that way, a continuous control of fabric web feed is accomplished, with the application of any tensile stresses to it, in particular in the machine direction, being prevented.

In order to optimize the operation of the fabric web deflection control device (19), the fabric web deflection control device (19) is accomplished by means of an optical-fibre reading unit (24) which is particularly advantageous on an environment saturated with steam, and at a high temperature. In fact, the optical-fibre reading unit (24) detects the distance of the fabric web (13) from a support plate (25) together with which it constitutes the fabric web deflection control device (19). Then it transmits a signal to a converter, not shown in the FIGURE, which consequently acts on the regulation of the revolution speed of the motor-driven roller (18).

The fabric web deflection control device (19) is particularly advantageous because it makes it possible the fabric web (13) to be overfeeded to the conveyor belt (12) in such a way as to compensate for the reduction in length of the fabric web caused by its longitudinal shrinkage.

When necessary, in order to favour the sliding and rearrangement of the fibres and/or yarns which constitute the fabric web (13), the vibrator device (22) can be started up which, by acting on the conveyor belt (12), transmits a corresponding vertical vibrational movement to the fabric web (13) during its advancing motion.

During the operation, as already mentioned, the temperature sensor (23) performs the function of detecting, through a temperature detection, the presence of steam inside the interior of the tunnel (11) and of automatically regulating the steam emission through the steam delivering device (16). In that way, steam is prevented from escaping from the tunnel into the working premises, and, simultaneously, the steam emission is exactly metered as a function of the amount which is absorbed by the fabric web (13).

By means of the apparatus according to the present invention, steam consumption can hence be limited to the strictly necessary for the treatment of the fabric, and the presence can be avoided of any suction devices, thus any useless wastes and consequent energy costs being eliminated.

Furthermore, by means of an apparatus according to the present invention, a further feature is evidenced, which is advantageous from the technological aspect of fabric treatment.

In fact, since the steaming treatment is carried out in an apparatus in which no air is present, the fabric undergoes a considerably higher dimensional stabilization than allowed by the traditional steaming processes carried out in apparatuses in which a mixture of air and steam is present.

A further advantage of the apparatus disclosed above is the possibility of reaching, inside the steaming tunnel (11), such steam temperatures that the latter will be overheated and saturated. The temperatures of the overheated saturated steam atmosphere can be regulated up to values comprised within the range of from 100° to 120° C. due to the presence of the heated plates (20) and (21). Furthermore, the latter feature, as already stated, enables the temperature to be more accurately regulated, with undesirable phenomena of steam condensation being prevented.

I claim:

1. Apparatus for continuously steaming and stabilizing a continuous fabric web, comprising:

a generally horizontally arranged, longitudinally elongated, substantially closed steaming tunnel having an inlet opening for said fabric web provided at an upstream end, an outlet opening for said fabric web provided at a downstream end;

an endless conveyor belt which enters said tunnel through said inlet opening, and exits from said tunnel through said outlet opening;

upstream and downstream guide rollers arranged within said tunnel and supporting a portion of the endless conveyor belt within said tunnel to provide an upwardly facing, generally horizontal carrying run of said endless conveyor belt, said carrying run thereby having an upstream end and a downstream end;

a steam delivering device penetrating into said tunnel for delivering steam to said continuous fabric on said carrying run of said endless conveyor belt;

said inlet and outlet openings being disposed below said carrying run of said endless conveyor belt;

a temperature sensor disposed within said tunnel adjacent at least one of said inlet and outlet openings, said temperature sensor being operatively associated with said steam delivering device, for controlling delivery of steam to said continuous fabric on said carrying run of said endless conveyor, in response to elevation of temperature as an indication that if steam delivery is not reduced temporarily, excess steam will escape from the tunnel through at least one of said inlet and outlet openings.

2. The apparatus of claim 1, wherein:

both said inlet and outlet openings are directed downwardly.

3. The apparatus of claim 1, further including:

a motor-driven roller disposed within said tunnel over said carrying run of said endless conveyor belt near the upstream end of said carrying run and being arranged about said carrying run for drawing succeeding longitudinally successive increments of said continuous fabric web into said tunnel through said inlet opening and successively depositing such increments onto said carrying run near said upstream end of said carrying run.

4. The apparatus of claim 3, further including:

a fabric web deflection control device disposed within said tunnel between said motor-driven roller and said carrying run of said endless conveyor belt and arrange to sense proximity to said fabric web deflection control device of successive increments of said continuous fabric web as said successive increments drape from said motor-driven roller, down onto said carrying run;

said fabric web deflection control device being operatively associated with said motor-driven roller for maintaining a given amount of proximity of such increments by controlling speed of rotation of said motor-driven roller.

5. The apparatus of claim 4, wherein:

said fabric web deflection control device includes an optical fibre reading unit installed on a support plate as a detector input for detecting proximity of successive increments of the continuous fabric web to said support plate.

6. The apparatus of claim 1, further including:

at least one upper heated plate disposed within said tunnel and facing said carrying run from above, for heating successive increments of said continuous fabric web from above; and at least one lower heated plate disposed within said tunnel and facing said carrying run from below, for heating successive increments of said continuous fabric web from below.

7. The apparatus of claim 6, further comprising:

a temperature sensor disposed within said tunnel and operatively associated with said upper and lower heated plates for controlling heating of said plates in response to temperature sensed by this temperature sensor.

8. The apparatus of claim 1, further comprising:

a vibrator operatively associated with said tunnel for inducing vibrations to said carrying run of said endless conveyor belt, and thereby, to successive increments of said continuous fabric web, for helping said successive increments of said continuous fabric web to slide and rearrange on said carrying run of said endless conveyor belt.

* * * * *